United States Patent [19]

Maire et al.

[11] 4,255,245

[45] Mar. 10, 1981

[54] ELECTROLYSIS CELLS

[75] Inventors: Jacques Maire, Epinay-sur-Seine; Gérard Peré, Le Breuil, both of France

[73] Assignee: Creusot-Loire, Paris, France

[21] Appl. No.: 58,183

[22] Filed: Jul. 17, 1979

[30] Foreign Application Priority Data

Aug. 22, 1978 [FR] France ..... 78 24329

[51] Int. Cl.[3] ..... C25B 9/00; C25B 15/08

[52] U.S. Cl. ..... 204/257; 204/263; 204/255

[58] Field of Search ..... 204/252, 254, 256, 257, 204/268, 267, 270, 175, 128, 263, 255

[56] References Cited

U.S. PATENT DOCUMENTS

| | | | |
|---|---|---|---|
| 2,717,872 | 9/1955 | Zdansky | 204/256 |
| 3,324,023 | 6/1967 | Kircher | 204/256 |
| 3,875,040 | 4/1975 | Weltin et al. | 204/267 |
| 3,976,550 | 8/1976 | DeNora et al. | 204/128 X |

FOREIGN PATENT DOCUMENTS 892733 2/1972 Canada .

*Primary Examiner*—G. L. Kaplan
*Assistant Examiner*—D. R. Valentine
*Attorney, Agent, or Firm*—Haseltine & Lake

[57] ABSTRACT

The electrolysis cell, e.g. for use in the construction of an electrolyzer for the production of hydrogen on an industrial scale, comprises an alternate series of electrodes 1 to 7 and plane diaphragms 8 to 13, which are parallel and separated from one another by spaces 58 in which an electrolyte can circulate between inlets 16, 17 located on one face 14 of the cell and the outlets 18, 19 located on an opposite face 15 of the cell. The inlet and outlet faces 14, 15 of the cell are parallel to the electrodes and the inlets and outlets communicate with inlet and outlet channels 21 to 23 which extend perpendicular to the electrodes and are connected together by passages between the electrodes and diaphragms, alternate passages being connected to different inlets for different polarity electrolytes.

13 Claims, 14 Drawing Figures

ELECTROLYSIS CELLS

The present invention relates to an electrolysis cell, such as a cell for use in the construction of an electrolyser intended for the production of hydrogen on an industrial scale.

Electrolysers known at the present time generally consist of an agglomeration, for example a stack, of electrolysis cells. Each cell comprises one or more unit cells, each of which possesses, in succession, an anode, a diaphragm and a cathode, between which a liquid electrolyte circulates, the anolyte circulating between the anode and the adjacent face of the diaphragm and the catholyte circulating between the cathode and the other face of the diaphragm.

Studies carried out in the laboratory have shown the value of operating an electrolyser at elevated temperature and pressure, this making it possible to achieve an appreciable increase in the efficiency of the electrolyser. Reference may be made, for example, to an article by Mr. Paul Perroud, published in the "Revue Générale de l'Electricité", Volume 85, No. 7/8, July August 1976, pages 625 to 630.

The structures known hitherto present an enormous number of problems with regard to operation at high pressure and temperature. The joints are difficult to produce and sealing discs are increased in thickness so as to maintain the sealing pressure on the joints. This leads to an extremely expensive structure. It is clearly apparent that it is therefore advantageous to reduce the size by producing structures which are as compact as possible. Moreover, reduction in size makes it possible to employ inexpensive repetitive manufacturing techniques involving, for example, compression moulding or injection moulding.

Furthermore, with an electrolyser of compact structure, the gases, which are non-conductors, are carried away more rapidly; their concentration, and hence the resistivity of the medium between anode and cathode, is reduced, and this makes it possible, by reducing the resistance drop in this medium, to increase the efficiency of the electrolysis phenomenon for the same applied voltage.

According to the present invention there is provided an electrolysis cell comprising an alternate series of electrodes and plane diaphragm means, which electrodes and diaphragm means are parallel and separated from one another by spaces for circulation of an electrolyte between electrolyte inlets located on one face of said cell and electrolyte outlets located on the opposite face of said cell, wherein said inlet and outlet faces of said cell are parallel to said electrodes, each inlet orifice is contiguous to a rectilinear inlet channel which extends perpendicular to said electrodes through the cell to said outlet face which obstructs it on the outlet side, each outlet orifice is contiguous to a rectilinear outlet channel which extends perpendicular to said electrodes through the cell to said inlet face which obstructs it on the inlet side, and each inlet channel is connected to an outlet channel by passages located between an electrode and the adjacent diaphragm means, said passages connected to one inlet channel alternating with those connected to another inlet channel, such that in use, with the passage located between an electrode and the adjacent diaphragm means being traversed by an electrolyte of a first polarity, the passage located between said diaphragm means and the next adjacent electrode is traversed by an electrolyte of the other polarity.

The cell may be composed of one unit cell with two electrodes and one plane diaphragm, or, preferably, of a stack of unit cells, comprising an alternate series of electrodes and plane diaphragms.

Preferably in use said cell is positioned with said inlet and outlet faces vertical and with said passages inclined to the inclined position, said inclination being achieved by rotation about one of said inlet and outlet channels.

The above described cell may be manufactured using an insulating material which welds when heated from a crude form, for the production of electrically insulating parts of said cell, wherein a set of elements of the insulating material in the crude form is used which are held in place by wedges made of a solid material which can be dissolved, said insulating material is then welded by heating the structure, and then said wedges are destroyed by dissolving them.

Alternatively the cell may be manufactured using an injectable material for producing electrically insulating parts of said cell, wherein said injectable material is injected between the interstices left by wedges made of a material which can be dissolved, which wedges have been placed so as to hold said electrodes and diaphragm means in position, and then said wedges are destroyed by dissolving them, after having pierced the injection channels.

The invention will be more fully understood from the following description of an embodiment thereof, given by way of example only, with reference to the accompanying drawings.

Figure 1:
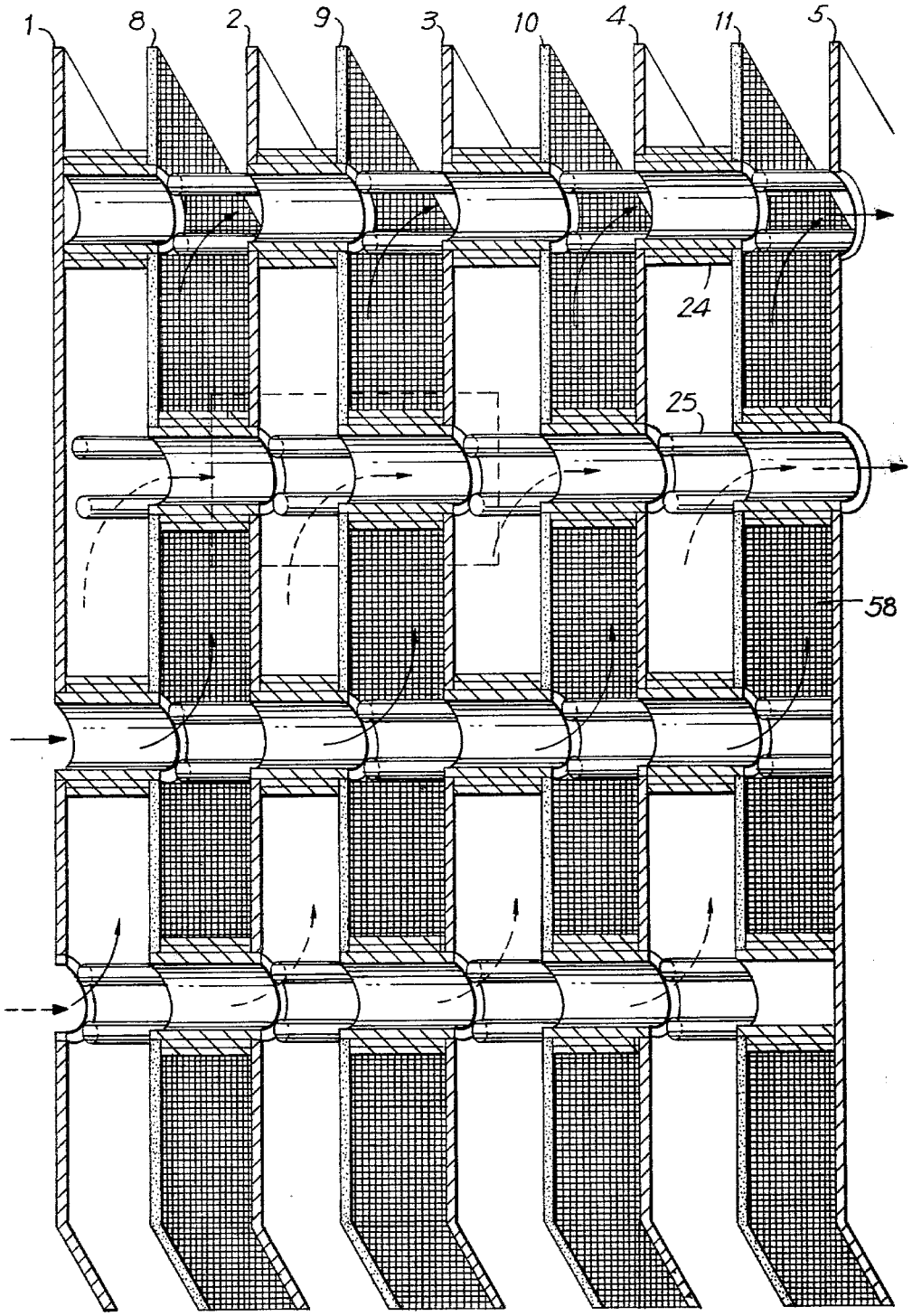
FIG. 1 is a perspective view in section of part of an embodiment of a cell according to the invention.

The cell shown in FIGS. 1 to 4 comprises electrode plates 1 to 7, for example made of nickel, and diaphragms 8 to 13 which are advantageously made of a temperature-resistant and pressure-resistant material, for example an asbestos board or a nickel fabric woven in crossed rep. The cell is closed on each side by a vertical metal inlet plate 14 and a vertical metal outlet plate 15, provided with orifices 16 and 17 and 18 and 19 respectively for the inlet and outlet of electrolyte. In a conventional manner, the electrodes and diaphragms are electrically insulated. In a cell or in a stack of cells, only the first and the last electrode plates are connected to each of the respective terminals of the electricity generator.

Each of the inlet orifices 16 and 17 communicates with and is contiguous to a rectilinear channel 20 and 21 which extends perpendicular to the electrodes and diaphragms and passes right through the cell as far as the outlet plate 15 which obstructs it; these channels will subsequently be referred to as the "inlet channels". Similarly, each of outlet orifices 18 and 19 communicates with and is contiguous to a rectilinear channel 22 and 23 which extends perpendicular to the electrodes and diaphragms and passes right through the cell as far as the inlet plate 14 which obstructs it; these channels will subsequently be referred to as the "outlet channels".

The electrodes and diaphragms are separated from one another by insulating spacers consisting either of spacer channels in the form of hollow cylinders 24 with solid walls, or of a set of small columns 25 which leave a vertical passage for the liquid, whilst forming a spacer. The small columns 25 can be replaced by equivalent means, such as a hollow cylinder of which the walls are provided with holes or with laminations, or by any supporting device permitting both the vertical and the horizontal passage of the liquid. Each cylinder 24 possesses a boss 26 which makes it possible to fit either an electrode or a diaphragm between this boss and part of the bearing surface of the small columns 25.

Along one and the same inlet or outlet channel, the cylinders 24 with solid walls and the sets of small columns 25 are arranged alternately. Furthermore, as shown in FIG. 3, the various inlet and outlet channels are arranged according to a square structure, the outlet channels being arranged at the centre of the squares of which the corners consist of the inlet channels, and vice versa.

Figure 3:
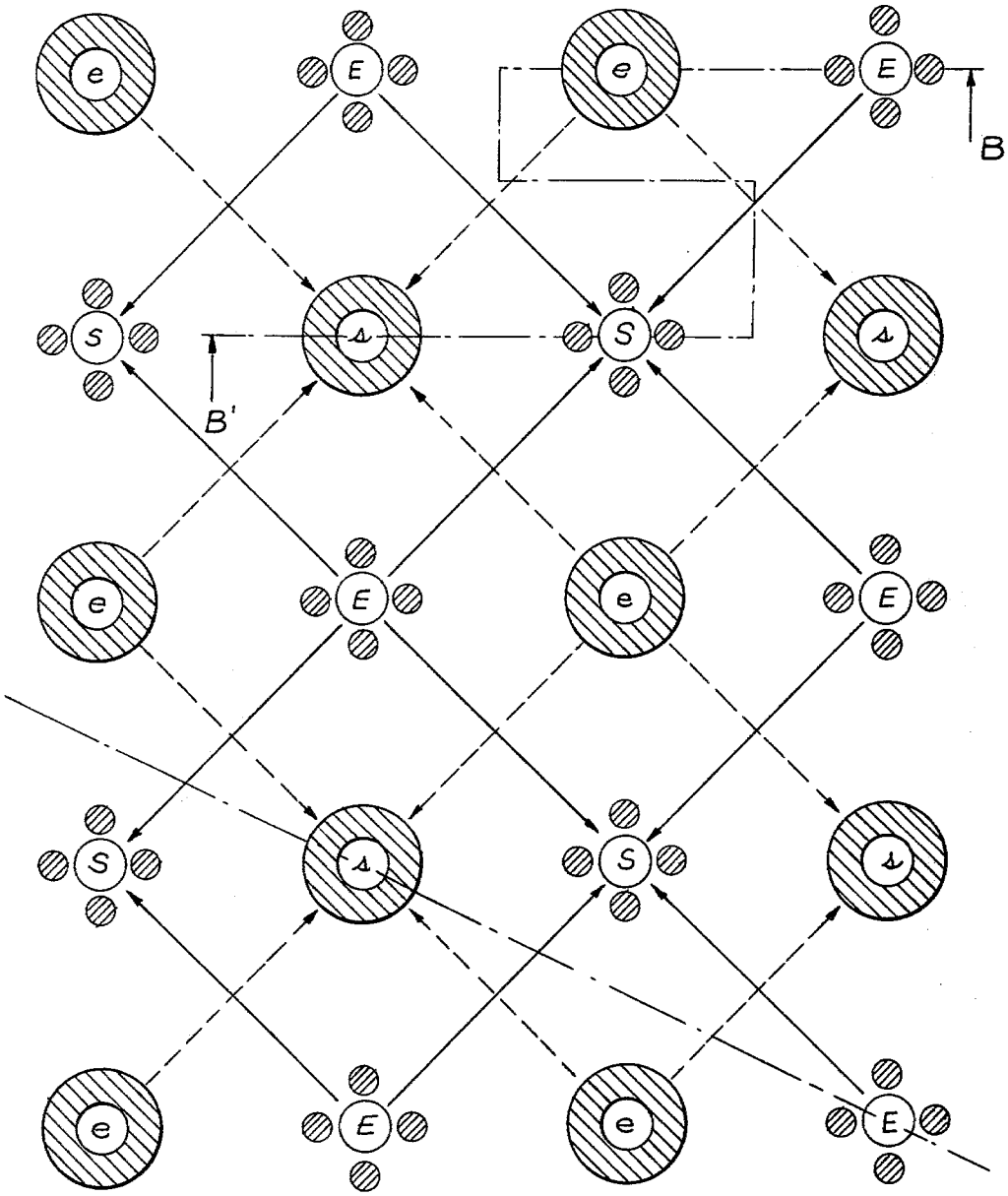
FIG. 3 is a section taken along the line AA' of FIG. 2.

In FIG. 3, the inlets for electrolyte of a first polarity, for example for anolyte, have been marked "E" and its outlets have been marked "S". Likewise, the inlets for electrolyte of a second polarity, for example for catholyte, have been marked "e" and its outlets have been marked "s".

Figure 2:
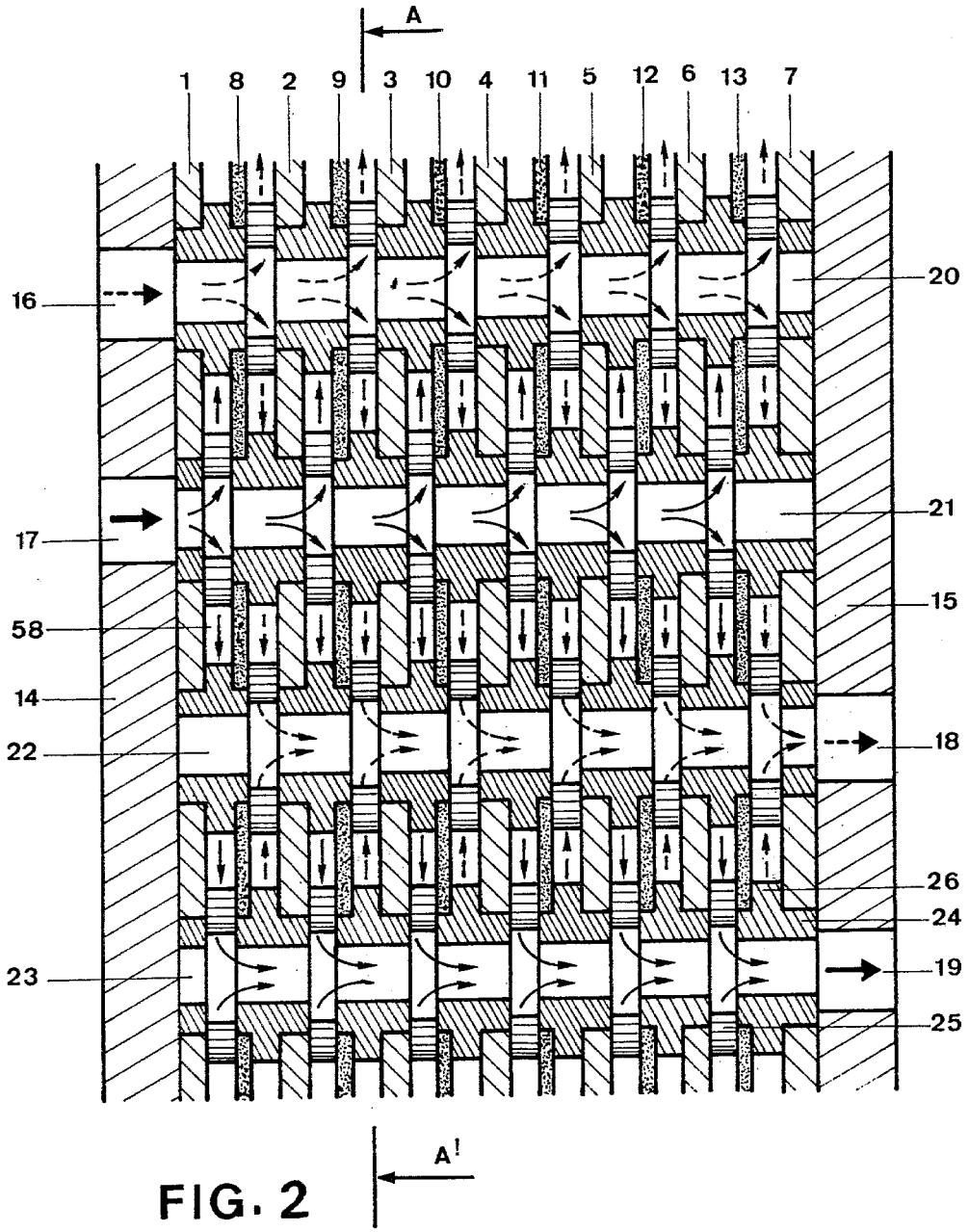
FIG. 2 is a view in section of a portion of the cell of FIG. 1, along the broken line BB' of FIG. 3.

The two types of spacer (24 and 25) delimit, between electrodes and diaphragms, vertical passages 58 for the electrolyte, which passages, as shown in FIGS. 1 and 2, are alternated for the anolyte and the catholyte. In these Figures, the path of the electrolyte of a first polarity has been represented by arrows in solid lines and the path of the electrolyte of a second polarity has been represented by arrows in dotted lines. The electrolyte paths can also be seen in the section in FIG. 3, in which the arrows in solid lines show the path of liquid in the plane of the section and the arrows in broken lines show the path of liquid in the electrode-diaphragm space above or below the space which is in the plane of the section.

As shown in FIGS. 1 to 3, the anolyte circulates, at every other level, between the inlet and outlet channels and also in these channels. The same applies to the catholyte, in alternation with the anolyte.

Figure 4:
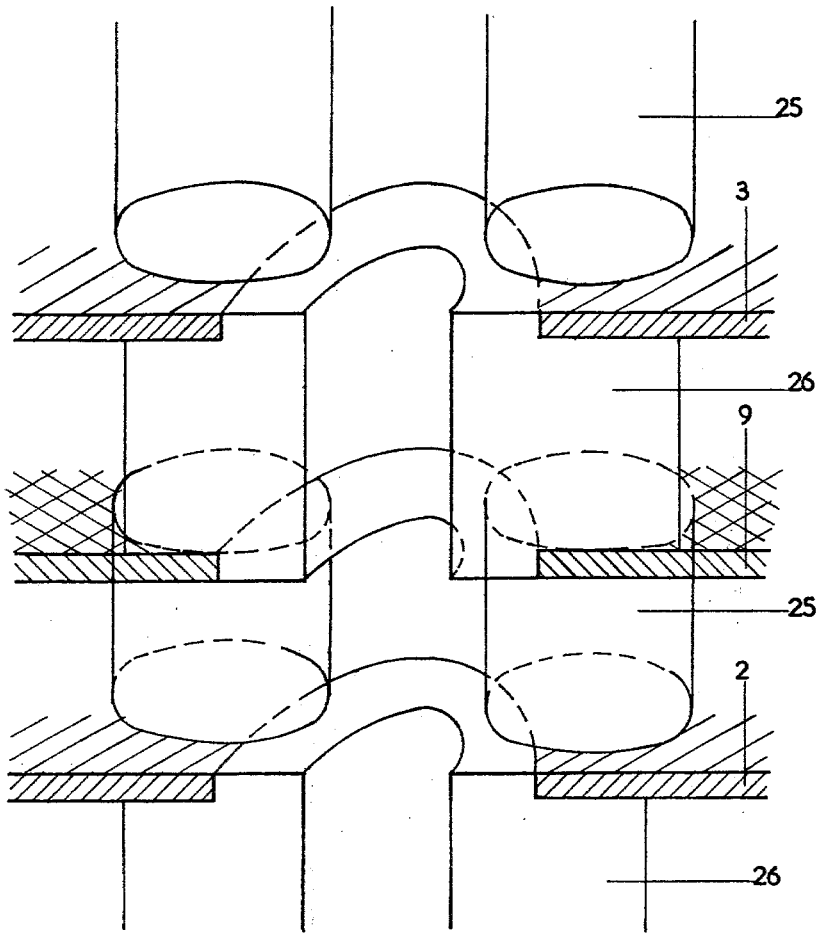
FIG. 4 is an enlarged view of a detail of FIG. 1, showing the actual size.

So that the flow of liquid is uniformly distributed, it is necessary that, in the vertical passages between the inlet and outlet channels, the pressure loss be large compared with the linear pressure loss in the inlet and outlet channels. For this purpose the small columns 25 actually have a larger diameter than that shown in FIGS. 1 to 3, for clarity of the drawing, and the distance between the channels is larger, as shown in FIG. 3 and not as shown in FIGS. 1 and 2 in which the relative dimensions have necessarily been altered considerably for clarity of the drawing. FIG. 4, which is an enlargement of the part of FIG. 1 enclosed in broken lines, provides a better illustration of the actual relative dimensions of the small columns and of the thicknesses of the various channels and passages, which permit an adequate pressure loss at these points by virtue of the narrow passages left between the small columns.

If the cell is orientated as shown in FIG. 2, it is likely that large gas bubbles will not be carried away by the stream of electrolyte and will conequently rise to the top of the cell and accumulate at this point. This phenomenon, if it occurs, results in a low current density in this top part, which is full of gas bubbles, and consequently in an unduly high current density in the bottom part of the cell, which causes electrochemical corrosion of the electrodes in this part. In order to prevent large bubbles from being able to reach the top part of the cell, the latter is inclined by rotation about an inlet or outlet channel. The dot-and-dash line shown in FIG. 3 corresponds, after inclination, to the vertical. An angle of inclination $\pi/8$ radians is particularly favourable because, as can be seen from FIG. 3, a rising bubble will either be trapped by a liquid inlet E, and therefore carried away, or will be crushed on a solid channel surrounding an outlet s or an inlet e, and will consequently either be broken up or directed sideways, which increases its chances of being trapped by an inlet.

Figure 5:
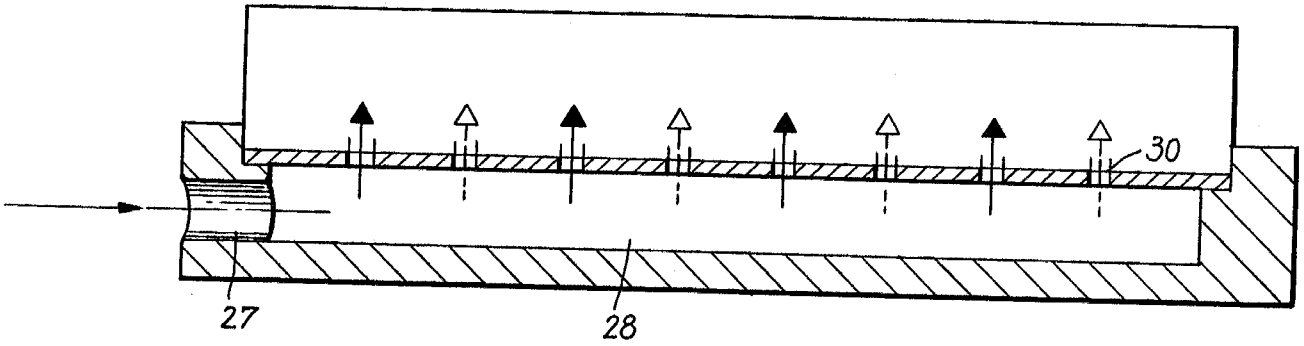
FIG. 5 is a schematic representation of an inlet case which may be used for a cell or a stack of cells according to the invention.
Figure 6:
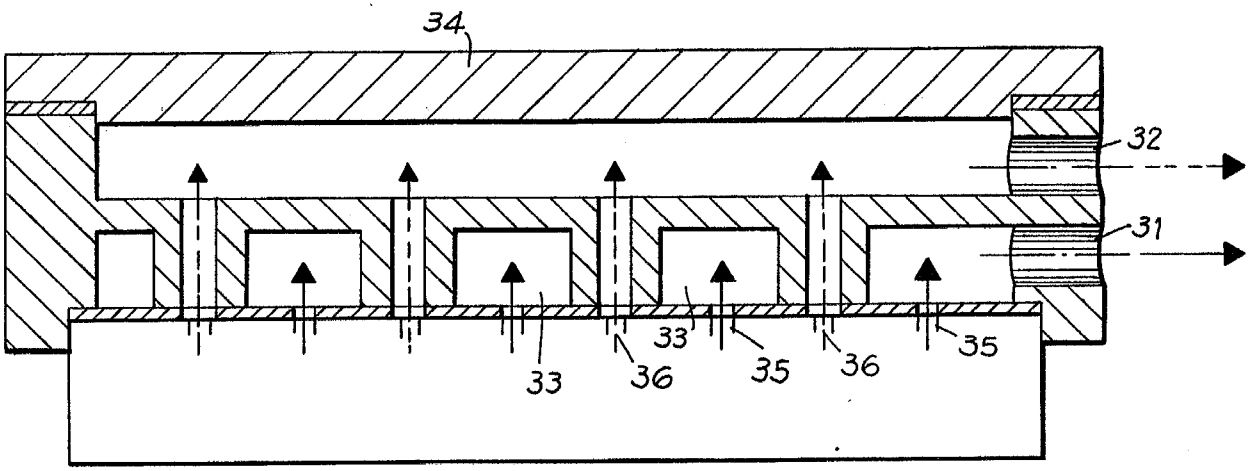
FIG. 6 is a schematic representation of an outlet case which can be used for a cell or a stack of cells according to the invention.

By stacking a plurality of cells as described above, or by associating them in another manner, for example via connecting cases, it is possible to construct an electrolyser which can function, if it is in a pressurised enclosure, under high pressure and at high temperature (for example a pressure of 70 bars and a temperature of 180° C.). FIGS. 5 and 6 are simplified diagrams of cases which can be used for such electrolysers. FIG. 5 shows an inlet case for electrolyte consisting, for example, of a solution of potassium hydroxide, which case possesses an inlet orifice 27, a common distribution space 28 and inlet channels 30. FIG. 6 similarly shows an outlet case which possesses an anolyte outlet orifice 31, a catholyte outlet orifice 32, an anlyte collection space 33, a catholyte collection space 34 , anolyte inlet channels 35 and catholyte inlet channels 36.

Figure 7:
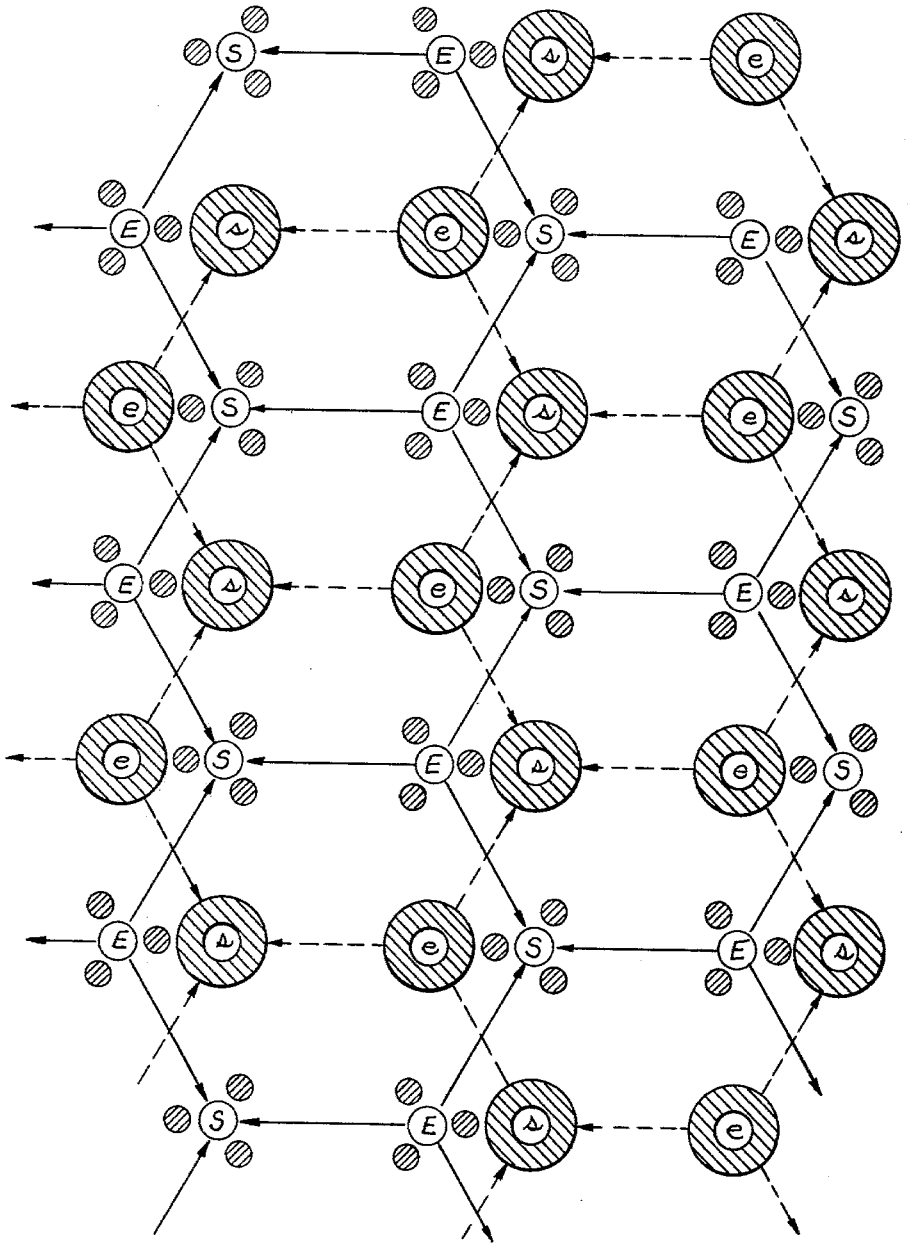
FIG. 7 is a view in section which is similar to that of FIG. 3 but relates to a cell of hexagonal structure.
Figure 8:
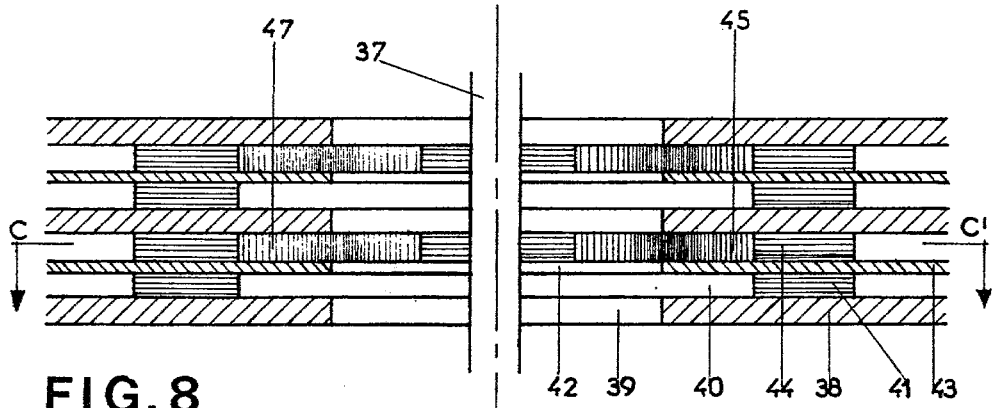
FIG. 8 shows, in lateral section, the first stage in the manufacture of a cell according to the invention.

In general, the functioning of the above described cell is the more satisfactory, the more uniform is the distribution of the fluid. The inventors have found experimentally that a cell as described above but utilising a distribution of the inlet and outlet channels according to a hexagonal structure permits a better distribution of fluid than the square structure of FIG. 3. Such a structure is shown in FIG. 7. This Figure shows that the hexagons of which the corners consist of the outlet channels are necessarily staggered relative to the hexagons consisting of the inlet channels. In fact, the choice between a square structure and a hexagonal structure will be governed by the question of cost price, the square structure being perfectly capable of sufficing in certain cases and being of simpler construction.

A particularly advantageous method of construction of a cell as described above will now be described with reference to FIGS. 8 to 14.

FIGS. 8 to 11 concern the construction of a cell, such as that which is partially shown in perspective in FIG. 4.

Figure 9:
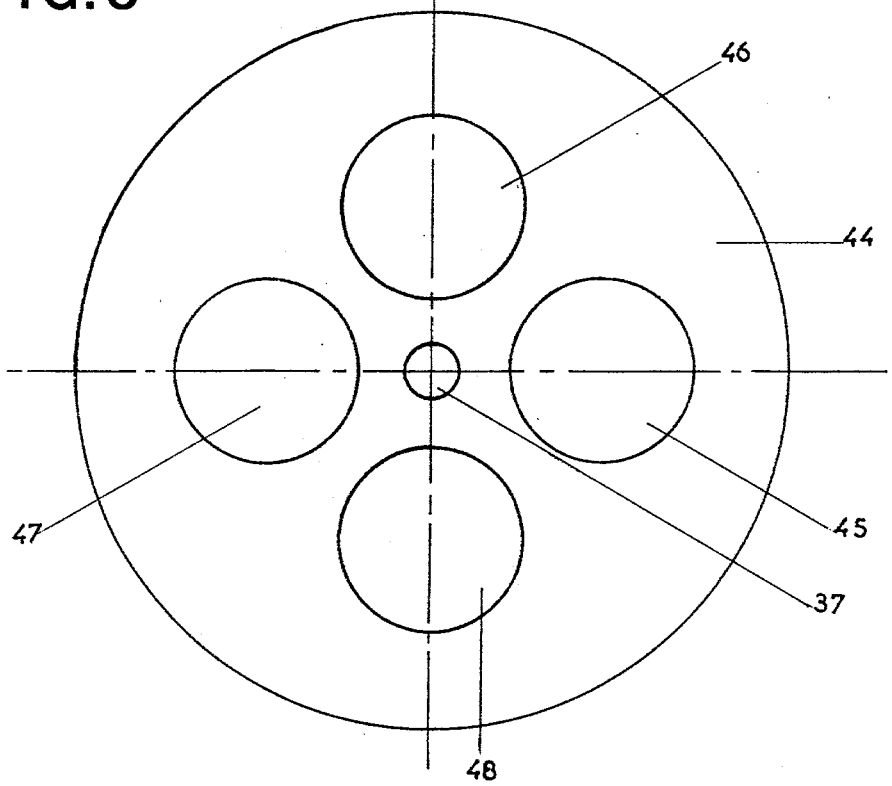
FIG. 9 is a section along the line CC' of FIG. 8.
Figure 10:
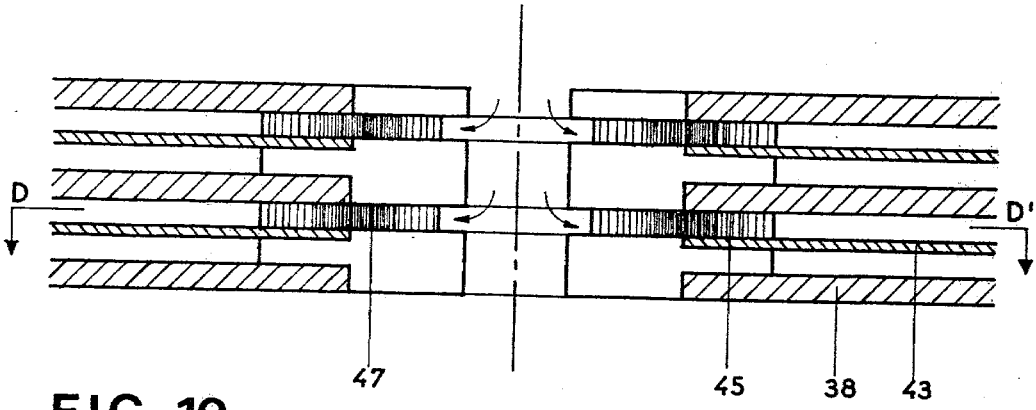
FIG. 10 shows, in lateral section, the second stage in the manufacture of a cell.
Figure 11:
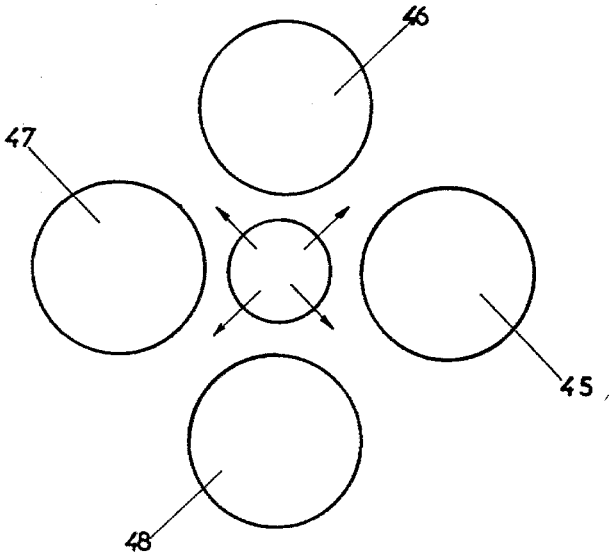
FIG. 11 is a section along the line DD' of FIG. 10.

The following stack is constructed around a temporary centering rod 37, placed along the axis of the inlet or outlet channel in question:

a first layer consisting of a nickel electrode 38 and a pellet 39 made of a material which can gel or set and weld under the action of heat but which is in the crude form, that is to say the non-gelled form; for example, the pellet is made of polytetrafluoroethylene (PTFE) in the crude form;

a second layer consisting of a pellet 40, also made of crude PTFE, the diameter of which is greater than that of the pellet 39 and which is surrounded by a ring 41 made of a solid material which can be dissolved by chemical attack, such as aluminium, the ring acting as a wedge or spacer;

a third layer consisting of a diaphragm 43, made of nickel rep, and a pellet 42, made of crude PTFE, which has the same diameter as the pellet 39;

a fourth layer which is intended for the construction of the small columns and consists, as also shown in FIG. 9, of an aluminium pellet 44 which has the same diameter as the ring 41 and is provided with four additional holes in which pellets 45, 46, 47 and 48, made of crude PTFE, have been inserted;

a fifth layer consisting of an electrode and a pellet made of crude PTFE, as for the first layer, and so on in a repetitive manner up to the last electrode.

The stack produced in this way is then compressed and heated at a temperature of about 340° C. until the PTFE gels. The assembly is then immersed in hot hydrochloric acid or concentrated sodium hydroxide solution so as to dissolve the aluminium wedges, and the structure represented diagrammatically in FIGS. 10 and 11, which is the cell structure as described above, is obtained.

Figure 12:
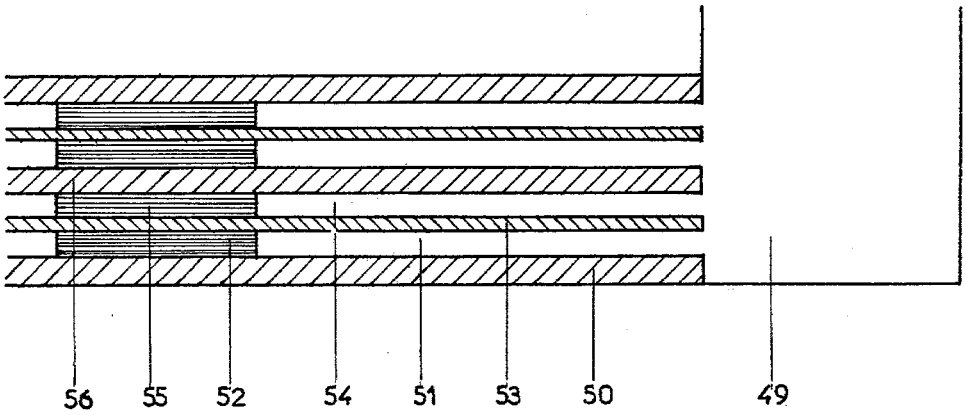
FIG. 12 shows, in lateral section, the first stage in the manufacture of an edge of a cell according to the invention.
Figure 13:
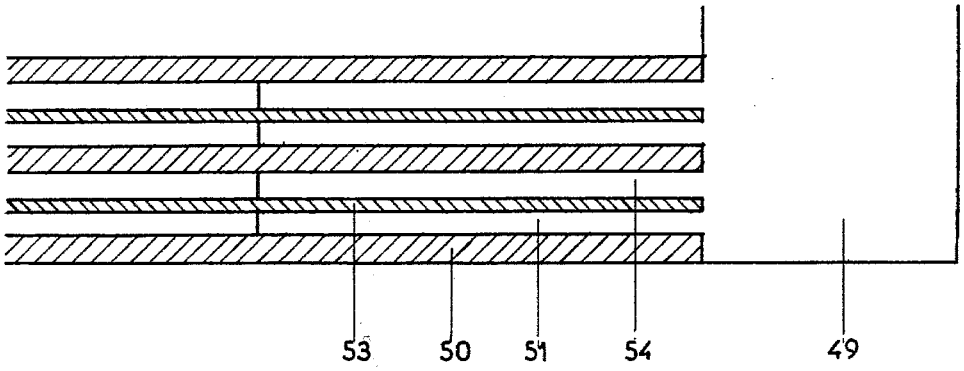
FIG. 13 shows, in lateral section, the second stage in the manufacture of the said edge.

FIGS. 12 and 13 show how the edges of the cell are produced by the same method.

According to FIG. 12, the following stack, which is surrounded by a wall 49 made of crude PTFE, is produced first:

an electrode 50;

a thin sheet 51, made of crude PTFE, which is contiguous to a wedge 52 consisting of a thin aluminium sheet;

a diaphragm 53;

a thin sheet 54, made of crude PTFE, which is contiguous to a wedge 55;

an electrode 56, and so on.

FIG. 13 shows the edge produced after gelling of the PTFE and dissolution of the aluminium wedges.

According to the construction shown in FIGS. 8 to 11, wedges are used which consist of pellets or rings and this can present centering problems when assembling the structure. According to a modification of the invention, manufacture is made easier by using, in one and the same plane parallel to the electrodes, and for the production of several orifices belonging to inlet and/or outlet channels, a wedge consisting of a single piece of aluminium, and by connecting several aluminium rings and pellets of FIG. 8 to give a single piece.

Figure 14:
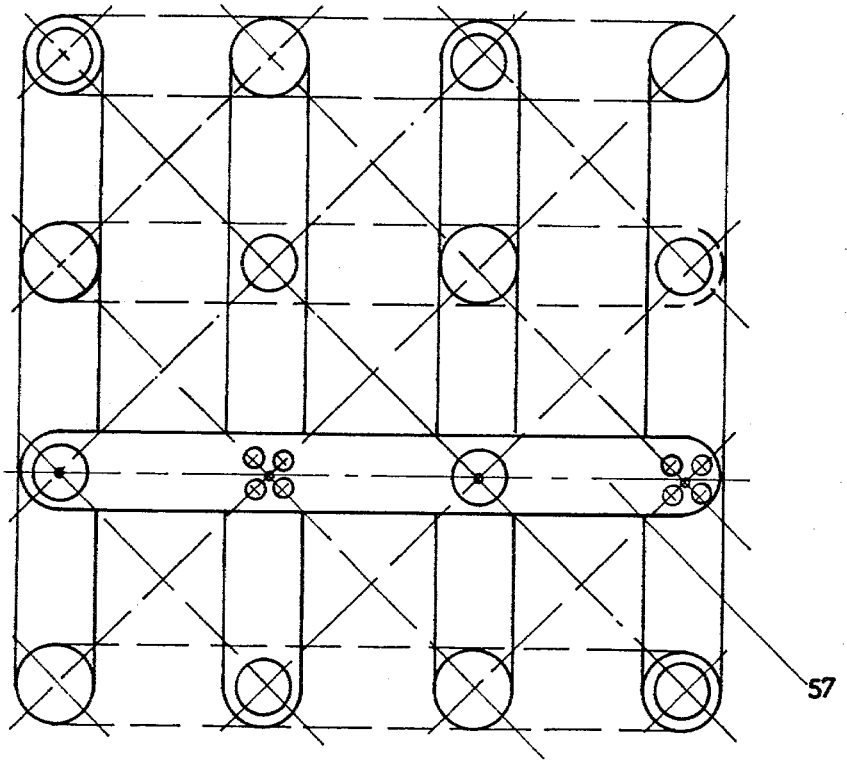
FIG. 14 shows an improved arrangement permitting a better construction in accordance with the method of manufacture of FIGS. 8 and 9.

For example, as shown in FIG. 14, small aluminium bars 57 are used, which group together, in an alternate manner, in one and the same plane, two wedges belonging to inlet channels and two wedges belonging to outlet channels. FIG. 14 also shows how these wedges are arranged on the whole structure so as to increase the rigidity thereof before gelling and dissolution treatment. Instead of small bars, wedges of other shapes can be used, such as, for example, wedges in the shape of a disc or of an arc of a circle.

It is self-evident that the method of manufacture described above, involving the gelling of a material such as PTFE, is not the only method which can be used. In a manner which is in itself known, the same assembly can be produced by injecting, through one end of the stack, a thermoplastic, such as for example, fluorinated ethylene/propylene (FEP), into the interstices left by the aluminium wedges which have been placed, as above, so as to hold the electrodes and diaphragms in position. In this case, in order to dissolve the aluminium wedges, the injection channels, which are filled at the moment of injection, must have been pierced beforehand. In this way, the dissolving agent, namely hydrochloric acid or concentrated sodium hydroxide solution, can reach the aluminium and attack it.

The invention finds its application in the industry for the production of gases such as hydrogen and oxygen.

What is claimed is:

1. An electrolysis cell comprising:

an alternate series of electrodes and a diaphragm means which are parallel and separated from each other by spaces for circulation of an electrolyte;

inlets for electrolyte in one face of said cell and which extend parallel to said electrodes;

outlets for electrolyte in another face of said cell opposite and parallel to said one face;

a rectilinear inlet channel in respect of each said inlet, each said inlet being contiguous with the corresponding, said inlet channel, each said inlet channel extending perpendicular to said electrodes through said cell to said other face which obstructs it;

a rectilinear outlet channel in respect of each said outlet, each said outlet being contiguous with the corresponding said outlet channel, each said outlet channel extending perpendicular to said electrodes through said cell to said one face which obstructs it;

passages located between said electrodes and said diaphragm means and connecting said inlet channels to said outlet channels, said ones of said passages connected to one said inlet alternating with said one of said passages connected to another of said inlets such that said passage located between a said electrode and the adjacent said diaphragm means is connected to said one inlet and said passage located between said diaphragm means and the next adjacent said electrode is connected to said other inlet channel such that in use said one passage can be traversed by an electrolyte of one polarity and said other passage can be traversed by an electrolyte of other polarity.

2. An electrolysis cell according to claim 1, wherein considered in a plane parallel to said electrodes, said inlet channels and said outlet channels are each arranged according to a square structure, said outlet channels being arranged at the centres of the squares of which the corners consist of said inlet channels, and vice versa.

3. An electrolysis cell according to claim 1, wherein considered in a plane parallel to said electrodes, said inlet channels and said outlet channels are each arranged according to a hexagonal structure.

4. An electrolysis cell according to claim 1, wherein the junction between a said passage and a said inlet or outlet channel is created between support means which are intercalated in the space delimiting each said passage.

5. An electrolysis cell according to claim 4, wherein each said support means is at least partially intercalated between the said electrode and the said diaphragm means delimiting said passage.

6. A process for use of an electrolysis cell according to claim 1, wherein said cell is positioned with said inlet and outlet faces vertical and with said passages inclined to the inclined position, said inclination being achieved by rotation about one of said inlet and outlet channels.

7. A process according to claim 6, for use of a cell according to claim 2, wherein said cell is inclined at an angle which is of the order of $\pi/8$ radians.

8. A process for the manufacture of an electrolysis cell according to claim 1, using an insulating material which welds when heated from a crude form for the production of electrically insulating parts of said cell, wherein a set of elements of the insulating material in the crude form is used which are held in place by wedges made of a solid material which can be dissolved, said insulating material is then welded by heating the structure, and then said wedges are destroyed by dissolving them.

9. A process for the manufacture of an electrolysis cell according to claim 1, using an injectable material for producing electrically insulating parts of said cell, wherein said injectable material is injected between the interstices left by wedges made of a material which can be dissolved, which wedges have been placed so as to hold said electrodes and diaphragm means in position, and then said wedges are destroyed by dissolving them, after having pierced the injection channels.

10. A process according to either claim 8 or claim 9, wherein in one and the same plane parallel to the electrodes, a wedge, consisting of a single piece made of a solid material which can be dissolved, is used for the production of several orifices of said inlet and/or outlet channels.

11. A process according to claim 10, wherein said single piece is such as to make it possible to envelop at least one orifice belonging to said inlet channel and at least one orifice belonging to said outlet channel.

12. A process according to claim 11, wherein said single piece is such as to make it possible to envelop two orifices belonging to two said outlet channels and two orifices belonging to two said inlet channels.

13. A process according to claim 12, wherein said single piece consists of small bars.

* * * * *